United States Patent [19]

Hessel et al.

[11] Patent Number: 4,523,512

[45] Date of Patent: Jun. 18, 1985

[54] TELESCOPIC SUPPORT PROPS FOR MINERAL MINING

[75] Inventors: Heinz Hessel, Flaesheim; Karl Heinz Plester, Lunen, both of Fed. Rep. of Germany

[73] Assignee: Gewerkschaft Eisenhutte Westfalia, Lunen, Fed. Rep. of Germany

[21] Appl. No.: 450,611

[22] Filed: Dec. 17, 1982

[30] Foreign Application Priority Data

Dec. 21, 1981 [DE] Fed. Rep. of Germany ..... 3150643

[51] Int. Cl.[3] ..... F15B 11/18

[52] U.S. Cl. ..... 91/168; 91/173; 91/207; 92/53

[58] Field of Search ..... 91/168, 173, 207, 208, 91/209, 169, 189 R; 92/53, 52, 51

[56] References Cited

U.S. PATENT DOCUMENTS

| | | | |
|---|---|---|---|
| 165,472 | 7/1875 | Brinckerhoff | 91/168 |
| 2,517,153 | 8/1950 | Wood | 91/169 |
| 2,933,070 | 4/1960 | Trumper et al. | 92/52 |
| 3,252,680 | 5/1966 | Lee et al. | 92/52 |
| 4,191,092 | 3/1980 | Farmer | 91/168 |

FOREIGN PATENT DOCUMENTS

| | | | |
|---|---|---|---|
| 1240743 | 5/1967 | Fed. Rep. of Germany | 91/168 |
| 877869 | 9/1961 | United Kingdom | 91/168 |

*Primary Examiner*—Paul E. Maslousky

*Attorney, Agent, or Firm*—Sughrue, Mion, Zinn, Macpeak & Seas

[57] ABSTRACT

A telescopic prop for use in mine workings extends and retracts over three stages. The prop has an outer main base member 1 with respective first, second and third concentric inner members 2, 3, 4 disposed one within another. The first inner member has a piston 6 in which is arranged a non-return valve 23 which normally shuts off communication between a working chamber 20 associated with the first and base members and the working chambers 22, 27, 29 pertaining to the other members. A plunger 24 is provided to open the non-return valve when the first inner member is nearly fully retracted inside the base member so that after retraction of this stage the other stages can be retracted. The second or intermediate member also employs a piston 9 which is connected via a rod 13 with an auxiliary piston 15 disposed in a working chamber associated with the uppermost third member. The areas of the working faces of the respective pistons are designed so that the prop has a practically equal supporting force over the its entire range of displacement.

6 Claims, 1 Drawing Figure

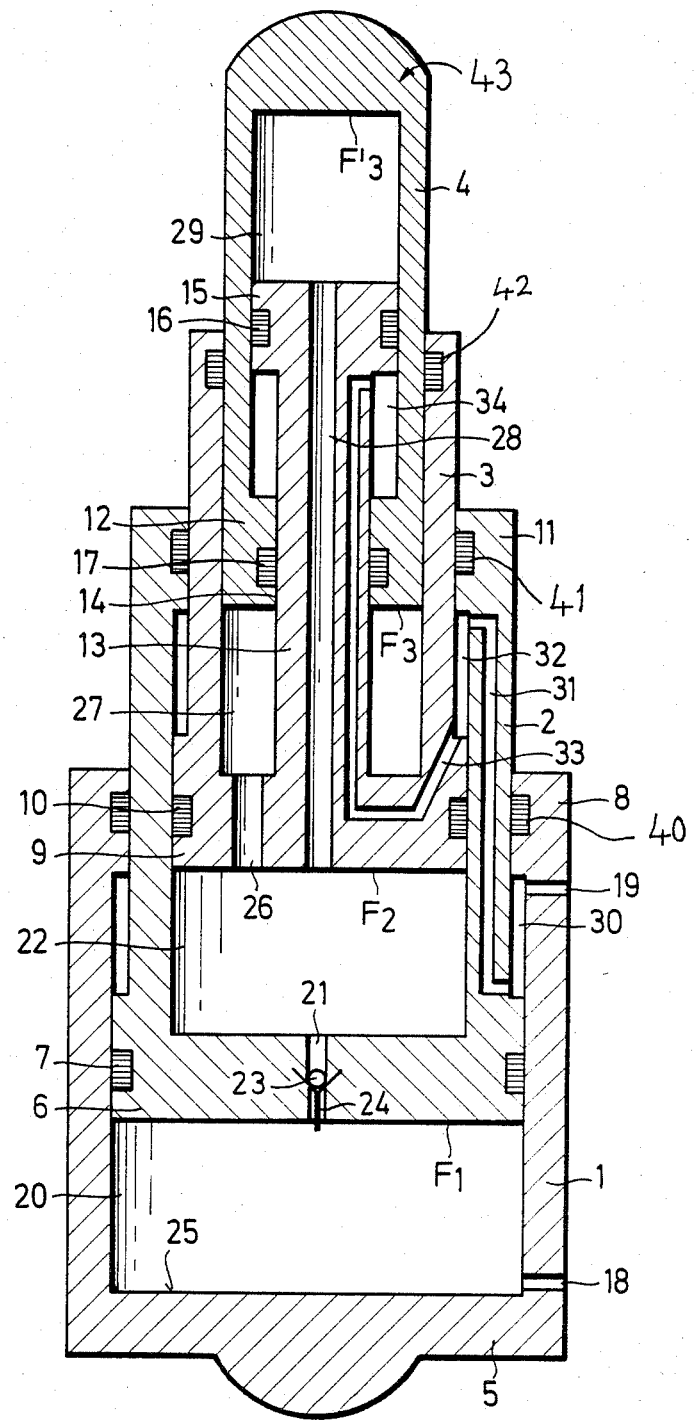
43
F'3
4
29
15
42
16
34
28
3
12
11
17
41
14
13
F3
32
31
27
2
33
10
8
40
9
19
26
F2
30
22
21
7
23
24
6
F1
1
20
25
18
5

TELESCOPIC SUPPORT PROPS FOR MINERAL MINING

BACKGROUND TO THE INVENTION

In the field of mineral mining, hydraulically-operated telescopic props are used extensively to support the roofs of mine workings. Such props normally have an outer base member supported directly or indirectly on the floor of the working and one or more inner concentric members which extend and retract in relation to the outer member in telescopic fashion.

Various types of support assemblies used in mine workings, such as walking supports or frames and shield supports, all employ multi-or single stage Props. A typical two stage prop of simple design is described in German Patent Specification No. 2 032 455. A typical known prop has an outer base member and a first inner member provided with a piston which can be subjected to hydraulic force when a working chamber in the base member is charged with pressure fluid. A spring-biased non-return valve can be provided on the piston of the first member and a plunger can operate this valve to permit communication between the working chamber in the base member and a working chamber in the first member. It is also known in the art, to provide telescopic props with additional chambers which can be charged with pressure fluid to forceably retract the prop stages. This is the so-called 'robbing aid'.

A general object of the present invention is to provide an improved form of telescopic prop.

SUMMARY OF THE INVENTION

According to the present invention there is provided a telescopic prop comprising an outer member, a first inner member disposed within said outer member and mounted for longitudinal displacement relative thereto, a second inner member disposed within the first inner member and mounted for longitudinal displacement relative thereto, a third inner member disposed within the second inner member and mounted for longitudinal displacement relative thereto, a first working chamber formed within the outer member and connectible to a source of hydraulic pressure fluid to effect prop extension, a piston of the first inner member with a first working face which is acted on by hydraulic pressure fluid in the first working chamber, a second working chamber formed within the first inner member, a piston of the second inner member with a second working face which is acted on by pressure fluid in the second working chamber, a third working chamber formed within said second member, a piston of the third inner member with a third working face which is acted on by pressure fluid in the third working chamber, a further working chamber formed within the third inner member which has a further working face which can be acted upon by pressure fluid in said further chamber, a further auxiliary piston confronting the working face in the third inner member and connected via a rod with said second piston, the rod passing through the third piston and being sealed with respect thereto, stop means for limiting the extension of each of the inner members and means establishing hydraulic communication between the second, third and further working chambers. The first piston is provided with a non-return valve which operates to block connection between the first and second working chambers and which is openable by associated actuating means when the first inner member is almost completely retracted within the outer member. The effective area of the first working face of the piston of the first inner member is larger than the effective area of the working faces of the other pistons and the effective area of the working face of the piston of the second inner member is approximately equal to the sum of the effective areas of the third and further working faces.

In a preferred construction a prop constructed in accordance with the invention has three stages and provides approximately equal supporting force for each of the stages. A prop constructed in accordance with the invention is particularly intended for use with support assemblies especially walking assemblies and goaf shield assemblies for workings with relatively shallow mineral seams.

The main outer or base member may have a bore leading to the working chamber therein which serves for the inflow and outflow of pressure fluid to and from all the stages of the prop. The actuating means for the non-return valve can be a plunger engageable with the inner inner surface of a base wall of the outer member.

During extension the first member is always fully extended before the outer members can extend and during retraction the first member is almost fully retracted before the other members can retract.

Preferably, further annular chambers are provided to permit pressure fluid to act on opposite faces of the pistons to those acted on by fluid during extension. These further chambers, which intercommunicate, can then receive fluid to retract the prop stages forceably when desired.

The stop means may at least include flanges at the upper ends of the outer member and the first inner member, respectively engageable with the piston of the first inner member and the piston of the second inner member. The auxiliary piston itself can constitute part of the stop means by engaging with the piston of the third inner member.

The invention may be understood more readily, and various other aspects and features of the invention may become apparent, from consideration of the following description.

BRIEF DESCRIPTION OF DRAWING

An embodiment of the invention will now be described, by way of example only, with reference to the accompanying drawing which is a diagrammatic, sectional side view of the support prop constructed in accordance with the invention.

DESCRIPTION OF PREFERRED EMBODIMENT

As shown in the drawing, a hydraulically-operated telescopic support prop has four tubular members 1,2,3,4 so that prop can be extended and retracted over three stages in all. It should be understood that in the representation of the prop shown in the accompanying drawing the members 2,3 and 4 are each shown partially extended to show the various working chambers etc. for reasons of clarity. In practice, however, this condition cannot occur since each stage extends and retracts in turn as described hereinafter. The outer, lowermost member 1 has a base wall 5 which closes off the lower end and forms a support foot for the prop. A first inner member 2 is slidably mounted within the outer member 1. Likewise, a second inner member 3 is slidably mounted within the first member 2 and a third inner member 4 is slidably mounted within the second member 3.

The inner member 2 has a lower wall forming a piston 6. The piston 6 is provided with a peripheral seal 7 slidably engaging the inner surface of the member 1. An inwardly-projecting flange 8 at the upper end of the outer member 1 is provided with a peripheral seal 40 slidably engaging the outer surface of the inner member 2. The flange 8 acts as a stop and contacts the piston 6 during extension of the member 2 to limit the outward movement of the member 2. The inner member 3 similarly has a lower wall forming a piston 9. The piston 9 is provided with a peripheral seal 10 slidably engaging the inner surface of the member 2. An inwardly-projecting flange 11 at the upper end of the member 2 is provided with a peripheral seal 41 slidably engaging with the outer surface of the inner member 3. The flange 11 also acts as stop and contacts the piston 9 during extension to limit the outward movement of the member 3. The piston 9 is connected through an axially-extending rod 13 to another, upper auxiliary piston 15 of small diameter within the inner member 4. The inner member 4 also has a lower wall forming a piston 12. The piston 12 is hollow and has a central bore 14 receiving the rod 13. The piston 12 has a peripheral seal 17 in the bore 14 slidably engaging the outer surface of the rod 13. The auxiliary piston 15 of the member 3 is also provided with a peripheral seal 16 slidably engaging the inner surface of the member 4. A further peripheral seal 42 is provided at the upper end zone of the inner surface of the member 3 and slidably engages with the exterior surface of the member 4. The pistons 12, 15 can contact one another during extension so that the piston 15 forms a stop to limit the outward movement of the member 4. The upper end region 43 of the member 4 forms a head for the prop.

The member 1 has a working chamber 20 therein for receiving hydraulic pressure fluid which acts on a working face F1 of the piston 6 of the member 2. The member 2 also has a working chamber 22 therein for receiving hydraulic pressure fluid which acts on a working face F2 of the piston 9 of the member 3. The member 3 has a working chamber 27 therein for receiving hydraulic pressure fluid which acts on a working face F3 of the piston 12 of the member 4. The member 4 has a working chamber 29 therein for receiving hydraulic pressure fluid which acts on a working face F'3 formed by the inner surface of the end region 43 forming the head of the member 4.

A bore 21 is provided at or near the centre of the piston 6 and a non-return valve 23 is located in the bore 21. The valve 23 can be a simple springless ball valve with a ball normally held on a seating to adopt a closed state. A plunger 24 is guided for longitudinal movement along the bore 21 and projects slightly below the working face F1 of the piston 6. This plunger 24 thus serves to raise the ball off its seating to open the valve 23 and allow communication between the chambers 20, 22 when the working face F1 is closely adjacent to the upper face 25 of the base wall 5. The raising of the ball by means of the plunger occurs when the member 2 is almost full retracted inside the member 1. The ball can also be raised off its seating when the pressure in the chamber 20 reaches a pre-determined value.

A bore 18 in the main wall member 1 near the surface 25 permits hydraulic pressure fluid to be fed to or from the chamber 20. Normally, the bore 18, which may be fitted with a suitable connector, would be linked to a setting valve provided with a pressure-relief valve. A further bore 19 in the main wall of the member 1 near the flange 8 thereof leads to an annular chamber 30 formed between the members 1, 2 and between the piston 6 and the flange 8 external to the chamber 22. The chamber 30 communicates with another annular chamber 32 formed between the members 2, 3 and between the piston 9 and the flange 11, external to the chamber 27, via a passageway 31 composed of a longitudinal bore and a radial bore in the main wall of the member 2. The chamber 32 likewise communicates with a further annular chamber 34 formed between the member 4 and the rod 13 and between the pistons 15, 12, external to the rod 13, via a passageway 33 composed of borings in the piston 9 and in the rod 13. The chambers 30, 32, 34 are hence always in hydraulic communication. Hydraulic pressure fluid can be admitted to the chambers 30, 32, 34 to retract the members 2, 3, 4 telescopically inside the member 1 forceably as a so-called 'robbing aid'.

The chamber 22 communicates with the chamber 27 via a bore 26 in the piston 9 and also with the chamber 29 via an axial passageway 28 extending through the rod 13. Thus, the chambers 22, 27, 29 are always in hydraulic communication with one another.

The effective working area of the face F1 of the piston 6 is larger than the effective working area of the face F2 of the piston 9. The effective working area of this latter face F2 is approximately equal to the sum of the working areas of the other faces F3, F'3 and more preferably is just slightly greater than the latter collective areas.

The operation of the prop is as follows: When the prop is to be extended and set, pressure fluid is passed into the chamber 20 via the bore 18. The member 2 then extends from the member 1 and carries the members 3, 4 with it. Since the area of the face F1 is larger than that of the faces F2, F3 the setting force is determined by the pressure of the hydraulic fluid and the area of the face F1. When the piston 6 is brought into contact with the flange 8 the pressure in the chamber 20 rises and the valve 23 is designed to open to allow pressure fluid to enter the chamber 22. The member 3 now extends from the member 2 and carries the member 4 with it. If the piston 9 is brought into contact with the flange 11 before a cap or roof-engagable structure carried by the member 4 contacts the roof then pressure fluid will flow into the chambers 27, 29 to extend the uppermost member 4 from the member 3. Depending on the height of the working one, two or all three stages of the prop may extend. The aforementioned relationship between the areas of the faces F1, F2, F3, F'3 ensures that the supporting force is more or less the same for each stage. If only the first stage, i.e. the member 2, extends during setting, then the load acting on the prop from the roof is transferred via the head region 43 of the uppermost member 4 and the pistons 15, 12, 9 and 6 to the pressure fluid cushion in the chamber 20 and thence by way of the prop foot and a skid or similar floor-engaging structure to the floor itself. The chamber 20 would be normally connected via a hydraulic circuit to a pressure-relief valve which opens if the pressure in the chamber 20 rises beyond a safe level. If the pressure does rise in this fashion the excess pressure is relieved and the prop will retract automatically in a controlled manner. If the members 2, 3 are both extended during setting then the load acting on the prop is transferred via the head region 43 of the uppermost member 4 and the pistons 15, 12, 9 to the pressure fluid cushion in the chamber 22. The chamber 22 is effectively isolated from the chamber 20 by the presence of the non-return valve 23. Since the working area of the face F2 is smaller of that of the face F1, a pressure prevails in the chamber 22 which is substantially higher than that in the chamber 20. The load force is thence transferred from the fluid cushions in the chambers 22, 20 to the floor as before. If the load exceeds the safety level, the relief valve would firstly permit outflow of fluid from the chamber 20 and the member 2 will retract with the members 3, 4 in the same relative positions. As the piston 6 approaches the surface 25, the valve 23 will become opened by the plunger 24 so that fluid can now pass from the chamber 22 through the open valve 23 to the chamber 20 for evacuation via the pressure-relief valve. As the member 3 retracts however, the outflow of fluid from the chamber 22 to the chamber 20 causes a surge of pressure which prevails for a short time in the chamber 20. This pressure surge in turn, causes the member 2 to extend slightly and the valve 23 closes again. This cycle may well be repeated several times over the full range of retraction of the member 3 with the member 2 extending and retracting and the valve 23 opening and closing in turn.

If all the members 2, 3, 4 are extended during setting then the load acting on the prop is transferred on the one hand, from the head region 43 of the prop to the fluid cushion in the chamber 29 and thence through the piston 15 and the rod 13 to the respective pistons 9, 6 and the fluid cushions in the respective chambers 22, 20 and on the other hand, from the head region 43 of the prop to the piston 12 and via the respective pistons 12, 9, 6 and the fluid cushions in the respective chambers 27, 22, 20. If the collective area of the faces F3, F'3 is somewhat less than that of the face F2, as is preferred, the setting force on the member 3 is somewhat greater than that on the member 4. If the pressure relief valve connected with the chamber 20 opens, the member 2 will be retracted until the plunger 24 again opens the valve 23. In this case however, fluid will pass out from the chamber 29 initially because of the smaller area of the working faces, F'3, F3 so that the member 4 will become retracted first before the member 3 begins to retract. The cycling of the valve 23 during the last phase of retraction when the member 3 is being retracted and the member 2 is extending and retracting occurs as before.

The setting valve by means of which the chamber 20 is charged with pressure fluid may also be provided with an alternative control mode to initiate forceable retraction of the prop in the manner known as a robbing aid. It is however possible to utilise the separate valve or control device for this purpose. In this operation, the bore 18 is connected with a hydraulic pressure fluid main return line and the bore 19 is connected with the pressure line. Fluid is then conducted into the chambers 30, 32 and 34 and all the members 2, 3 and 4 will be retracted as a result. During this operation, the member 2 will first retract until the non-return valve 23 is opened and then the member 4 will retract and then finally the member 3. During prop extension the bore 19 will be connected to the return line so that any fluid in the chambers 30, 32, 34 will be ejected as the members 2, 3, 4 of the prop extend in turn.

The prop as described is especially suitable for use with walking roof support assemblies employing goaf shields for use in mine workings with relatively shallow seams. The overall height of the prop can be made somewhat lower than that of a conventional two stage telescopic prop used hitherto and this enables the props to be set in a position more steeply inclined between the floor and the roof so that higher effective support force results.

We claim:

1. In or for a mine roof support, a telescopic prop comprising an outer member (1), a first inner member (2) disposed within said outer member and mounted for longitudinal displacement relative thereto, a second inner member (3) disposed within the first inner member and mounted for longitudinal displacement relative thereto, a third inner member (4) disposed within the second inner member and mounted for longitudinal displacement relative thereto, a first working chamber (20) formed within the outer member and connectible to a source of hydraulic pressure fluid to effect prop extension, a piston (6) of the first inner member with a first working face (F1) which is acted on by hydraulic pressure fluid in the first working chamber to effect initial extension of the first inner member and of the second and third inner members therewith, a second working chamber (22) formed within the first inner member, a piston (9) of the second inner member with a second working face (F2) which is acted on by pressure fluid admitted into the second working chamber after extension of the first inner member to effect secondary extension of the second inner member and of the third inner member therewith, a third working chamber (27) formed within said second member, a piston (12) of the third inner member with a third working face (F3) which is acted on by pressure fluid in the third working chamber, a further working chamber (29) formed within the third inner member which has a further working face (F'3) which can be acted upon by pressure fluid in said further chamber, a further auxiliary piston (15) confronting the working face in the third inner member and connected via a rod (13) with said second member piston to move therewith, the rod passing through the third member piston and being sealed with respect thereto, stop means (8, 11, 15) for limiting the extension of each of the inner members, means (26, 28) establishing hydraulic communication between the second, third and further working chambers to permit pressure fluid to enter the third and further working chambers from the second working chamber after extension of the second inner member to act on the third and further working faces to effect tertiary extension of the third inner member; a first annular chamber (30) between the outer member and the first inner member, a second annular chamber (32) between the first inner member and the second inner member and a third annular chamber (34) within the third inner member between the third and the further auxiliary pistons, and means (31, 33) establishing hydraulic communication between said annular chambers at least one of which is connectible to a source of hydraulic pressure fluid in order to effect forceable retraction of the first, second and third inner members, wherein the first piston is provided with a non-return valve (23) which operates to block connection between the first and second working chambers, said valve being opened by pressure in the first working chamber when the first inner member has been initially extended to allow fluid to enter the second working chamber and cause the secondary extension, and being opened by associated actuating means (24) when the first inner member is almost completely retracted within the outer member, and wherein the effective area of the first working face of the piston of the first inner member is larger than the effective area of the working faces of the other pistons, and the effective area of the working face of the piston of the second inner member is approximately equal to the sum of the effective areas of the third and further working faces.

2. A prop according to claim 1, wherein said stop means includes flanges at the upper ends of the outer member and the first inner member, respectively engageable with the piston of the first inner member and the piston of the second inner member.

3. A prop according to claim 2, wherein said stop means further comprises the further auxiliary piston which is engageable with the piston of the third inner member.

4. A prop according to claim 1, wherein the actuating means for the non-return valve is a plunger engageable with the inner surface of a base wall of the outer member.

5. A prop according to claim 2, wherein peripheral seals are provided between the pistons and respective slidable surfaces of the members and between the flanges and respective slidable surfaces of the members.

6. A prop according to claim 1, wherein the effective area of the second working face of the piston of the second inner member is slightly greater than the sum of the effective areas of the third and further working faces.

* * * * *